US011466902B2

(12) United States Patent
Braun et al.

(10) Patent No.: US 11,466,902 B2
(45) Date of Patent: Oct. 11, 2022

(54) VAPOR COMPRESSION REFRIGERATION SYSTEM

(71) Applicant: Purdue Research Foundation, West Lafayette, IN (US)

(72) Inventors: James E Braun, West Lafayette, IN (US); Eckhard A Groll, West Lafayette, IN (US); Xinye Zhang, West Lafayette, IN (US); Davide Ziviani, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 99 days.

(21) Appl. No.: 16/839,338

(22) Filed: Apr. 3, 2020

(65) Prior Publication Data

US 2020/0333048 A1 Oct. 22, 2020

Related U.S. Application Data

(60) Provisional application No. 62/834,610, filed on Apr. 16, 2019.

(51) Int. Cl.

| | |
|---|---|
| ***F25B 1/02*** | (2006.01) |
| ***F25B 40/06*** | (2006.01) |
| ***F25B 19/00*** | (2006.01) |

(52) U.S. Cl.

CPC ..... *F25B 1/02* (2013.01); *F25B 19/005* (2013.01); *F25B 40/06* (2013.01)

(58) Field of Classification Search

CPC ..... F25B 1/02; F25B 19/005; F25B 40/06; F25B 2400/0409; F25B 31/008; F25B 2400/072; F25B 31/006; F04B 39/064

See application file for complete search history.

(56) References Cited

U.S. PATENT DOCUMENTS

| | | | | |
|---|---|---|---|---|
| 3,913,346 | A * | 10/1975 | Moody, Jr. | F04C 29/042 62/197 |
| 5,694,780 | A * | 12/1997 | Alsenz | F04B 39/064 62/117 |
| 6,619,936 | B2 | 9/2003 | Perevozchikov | |
| 6,938,438 | B2 | 9/2005 | Lifson et al. | |
| 8,181,478 | B2 * | 5/2012 | Ignatiev | F25B 31/002 62/468 |
| 8,601,935 | B2 | 12/2013 | Giacchi et al. | |
| 9,863,410 | B2 | 1/2018 | Kim et al. | |
| 2010/0115975 | A1 * | 5/2010 | Mitra | F25B 1/10 62/196.1 |
| 2017/0343244 | A1 * | 11/2017 | Ascani | F25B 1/02 |
| 2020/0130472 | A1 * | 4/2020 | Durrani | B60H 1/3223 |

OTHER PUBLICATIONS

M. Tello Oquendo F. et al., A Methodology for Characterization of Vapor injection Compressors. 23rd International Compressor Engineering Conference at Purdue, Jul. 11-14, 2016.

Liang K. et al., A Review of Linear Compressors for Refrigeration, International Journal of Refrigeration, vol. 84, Dec. 2017, pp. 253-273. https://doi.org/10.1016/j.ijrefrig.2017.08.015.

* cited by examiner

*Primary Examiner* — David J Teitelbaum

(74) *Attorney, Agent, or Firm* — Purdue Research Foundation

(57) ABSTRACT

The present disclosure relates to a novel vapor compression refrigeration system, and the methods of making and using the vapor compression refrigeration system.

5 Claims, 10 Drawing Sheets

(a)

(b)

VAPOR COMPRESSION REFRIGERATION SYSTEM

CROSS-REFERENCE TO RELATED APPLICATION

This application claims the priority benefit of U.S. Provisional Patent Application No. 62/834,610, filed Apr. 16, 2019, which is incorporated herein by reference in its entirety.

TECHNICAL FIELD

The present disclosure relates to a novel vapor compression refrigeration system, and the methods of making and using the vapor compression refrigeration system.

BACKGROUND

This section introduces aspects that may help facilitate a better understanding of the disclosure. Accordingly, these statements are to be read in this light and are not to be understood as admissions about what is or is not prior art.

Compressor performance is often referenced to one of three ideal reference processes: adiabatic, polytropic, and isothermal. These different reference processes have been extensively investigated and compared. It is well known that an adiabatic and reversible (isentropic) compression process requires more work input than an isothermal and reversible compression process for the same suction conditions and discharge pressure. However, in order to establish an isothermal process, the heat generated during the compression process must be removed from the system at the same rate that it is added by the mechanical work of compression. Isothermal compression processes are extremely difficult to achieve due to the fact that two opposing effects need to be balanced. On one hand, the isothermal compression process needs to occur in small confined volumes at very high speeds in order to achieve high efficiencies. On the other hand, the heat transfer process needs to take place over large surfaces at very slow velocities to achieve high effectiveness. As a consequence, isothermal compression has not been approached in a real application.

Different approaches have been investigated to approach an isothermal compression process. For instance, the use of multi-stage compression with inter-cooling could be used to remove the compression heat. However, this approach results in complex systems with high manufacturing costs.

Therefore, novel vapor compression refrigeration systems with better performance are still needed.

SUMMARY

The present invention provides a novel vapor compression refrigeration system, and the methods of making and using the vapor compression refrigeration system.

In one embodiment, the present disclosure provides a vapor compression refrigeration system, wherein the system comprises a main circuit comprising:

a compressor comprising a compression chamber and a cooling chamber, wherein the compression chamber further comprises a first inlet and a first outlet, and the cooling chamber further comprises a second inlet and a second outlet;

a condenser configured to receive a superheated pressurized gaseous refrigerant from the first outlet of the compression chamber, and to condense the superheated pressurized gaseous refrigerant to a sub-cooled refrigerant liquid;

a regenerator configured for heat exchanging;

an evaporator configured to convert a liquid/gaseous two-phase refrigerant to a gaseous refrigerant;

an injection line between the condenser and the second inlet of the cooling chamber of the compressor, wherein a first throttle valve is placed on the injection line, and the first throttle valve is configured to convert a liquid refrigerant to a liquid/gaseous two-phase refrigerant; and an evaporation line connecting the condenser and the evaporator, wherein a second throttle valve is placed on the evaporation line, and the second throttle valve is configured to convert a liquid refrigerant to a liquid/gaseous two-phase refrigerant.

In another embodiment, the present disclosure provides methods of making and using the vapor compression refrigeration system.

DETAILED DESCRIPTION

Figure 1:
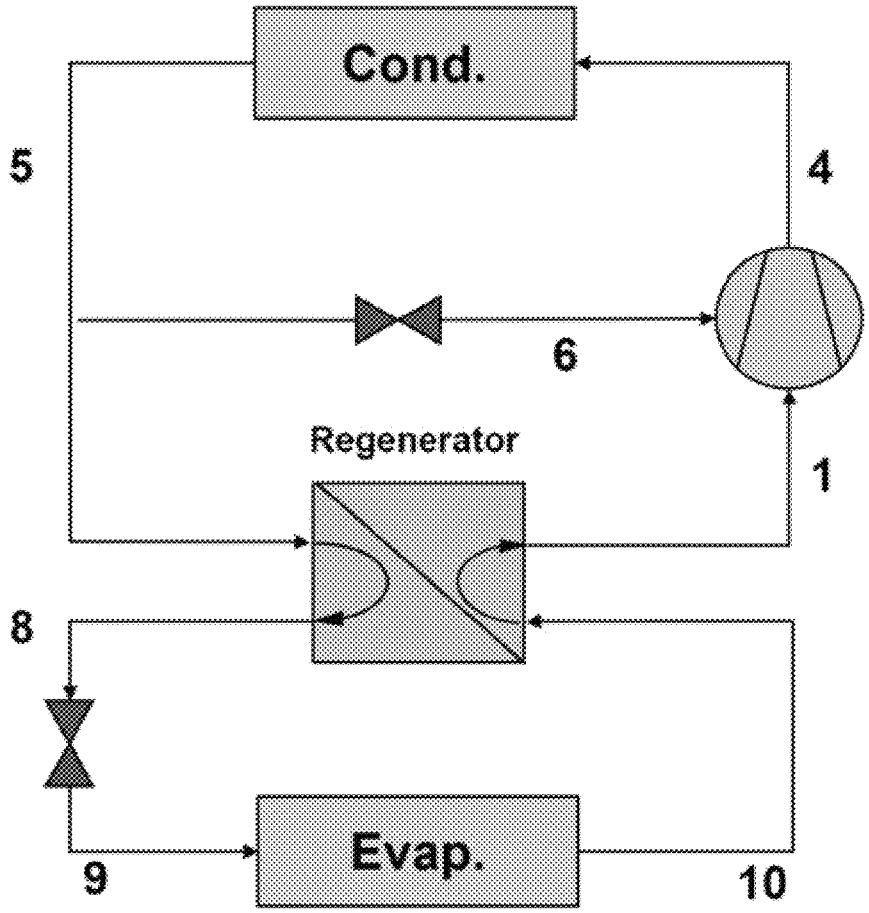
FIG. 1 illustrates a circuit comprising an integrated vapor compression refrigeration system.

For the purposes of promoting an understanding of the principles of the present disclosure, reference will now be made to embodiments illustrated in drawings, and specific language will be used to describe the same. It will nevertheless be understood that no limitation of the scope of this disclosure is thereby intended.

In the present disclosure the term "about" can allow for a degree of variability in a value or range, for example, within 10%, within 5%, or within 1% of a stated value or of a stated limit of a range.

In the present disclosure the term "substantially" can allow for a degree of variability in a value or range, for example, within 90%, within 95%, or within 99% of a stated value or of a stated limit of a range.

In the present disclosure the term "compressor" refers to a mechanical device that increases the pressure of a gas by reducing its volume. The term "condenser" refers to a device or unit used to condense a substance from its gaseous to its liquid state, by cooling it. The term "evaporator" refers to a device in a process used to turn the liquid form of a substance such as water into its gaseous-form/vapor. The term "coolant passage" refers to equipped cooling microchannels within compressor cylinder to absorb the heat from compression chamber. The term "throttle valve" refers to a device to control and regulate the refrigerant flow by reducing the pressure. The term "regenerator" refers to a type of heat exchanger where heat from the hot fluid is intermittently stored in a thermal storage medium before it is transferred to the cold fluid.

The present invention provides a novel vapor compression refrigeration system, and the methods of making and using the vapor compression refrigeration system. In particular, a novel cylinder cooling design in a linear compressor and its evaluation when integrated within a vapor compression cycle (VCC) are provided.

In one embodiment, the present disclosure provides a vapor compression refrigeration system, wherein the system comprises a main circuit comprising:

a compressor comprising a compression chamber and a cooling chamber, wherein the compression chamber further comprises a first inlet and a first outlet, and the cooling chamber further comprises a second inlet and a second outlet;

a condenser configured to receive a superheated pressurized gaseous refrigerant from the first outlet of the compression chamber, and to condense the superheated pressurized gaseous refrigerant to a sub-cooled refrigerant liquid;

a regenerator configured for heat exchanging;

an evaporator configured to convert a liquid/gaseous two-phase refrigerant to a gaseous refrigerant;

an injection line between the condenser and the second inlet of the cooling chamber of the compressor, wherein a first throttle valve is placed on the injection line, and the first throttle valve is configured to convert a liquid refrigerant to a liquid/gaseous two-phase refrigerant; and an evaporation line connecting the condenser and the evaporator, wherein a second throttle valve is placed on the evaporation line, and the second throttle valve is configured to convert a liquid refrigerant to a liquid/gaseous two-phase refrigerant.

In one embodiment regarding the vapor compression refrigeration system of the present disclosure, the second inlet and the second outlet of the cooling chamber are configured to allow the second inlet to receive the liquid/gaseous two-phase refrigerant from the first throttle valve to enter the cooling chamber to absorb heat generated from the compression chamber until the superheated gaseous refrigerant is achieved at the second outlet and allow the superheated gaseous refrigerant to be released from the second outlet and be injected to the compression chamber.

In one embodiment regarding the vapor compression refrigeration system of the present disclosure, the liquid/gaseous two-phase refrigerant from the second throttle valve is passed through the evaporator to become a first superheated gaseous refrigerant, and then passed through the regenerator to become a second more superheated gaseous refrigerant than the first superheated gaseous refrigerant, wherein the second more superheated gaseous refrigerant is delivered to the compression chamber to be compressed to a first compressed gaseous refrigerant.

In one embodiment regarding the vapor compression refrigeration system of the present disclosure, the first compressed gaseous refrigerant is mixed with the superheated gaseous refrigerant released from the second outlet of the cooling chamber to form a gaseous mixture, wherein the gaseous mixture is further compressed to a second compressed gaseous refrigerant.

In one embodiment regarding the vapor compression refrigeration system of the present disclosure, the mainstream of positive displacement compressor can be applied, including reciprocating piston compressor, linear compressor, rolling piston compressor, single/twin screw compressor, rotary compressor, etc.

In one embodiment regarding the vapor compression refrigeration system of the present disclosure, an oil-free linear compressor is used as an example.

In one embodiment, the present disclosure provides a refrigerating unit comprising the vapor compression refrigeration system as described in any embodiment of the present disclosure.

In one embodiment, the present disclosure provides a method for cooling a merchandise, wherein the method comprises:

providing a refrigerating unit;

placing a merchandise for cooling inside the refrigerating unit; and operating the refrigerating unit to cool the merchandise, wherein the refrigerating unit comprises:

a compressor comprising a compression chamber and a cooling chamber, wherein the compression chamber further comprises a first inlet and a first outlet, and the cooling chamber further comprises a second inlet and a second outlet;

a condenser configured to receive a superheated pressurized gaseous refrigerant from the first outlet of the compression chamber, and to condense the superheated pressurized gaseous refrigerant to a sub-cooled refrigerant liquid;

a regenerator configured for heat exchanging;

an evaporator configured to convert a liquid/gaseous two-phase refrigerant to a gaseous refrigerant;

an injection line between the condenser and the second inlet of the cooling chamber of the compressor, wherein a first throttle valve is placed on the injection line, and the first throttle valve is configured to convert a liquid refrigerant to a liquid/gaseous two-phase refrigerant; and an evaporation line connecting the condenser and the evaporator, wherein a second throttle valve is placed on the evaporation line, and the second throttle valve is configured to convert a liquid refrigerant to a liquid/gaseous two-phase refrigerant.

System Process Description

Figure 2:
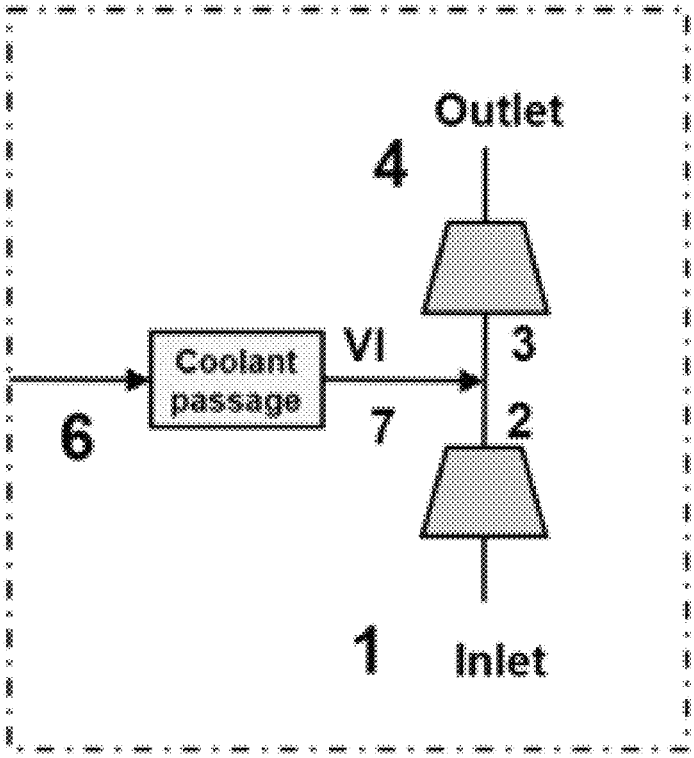
FIG. 2 illustrates the cooling passage/chamber.
Figure 3:
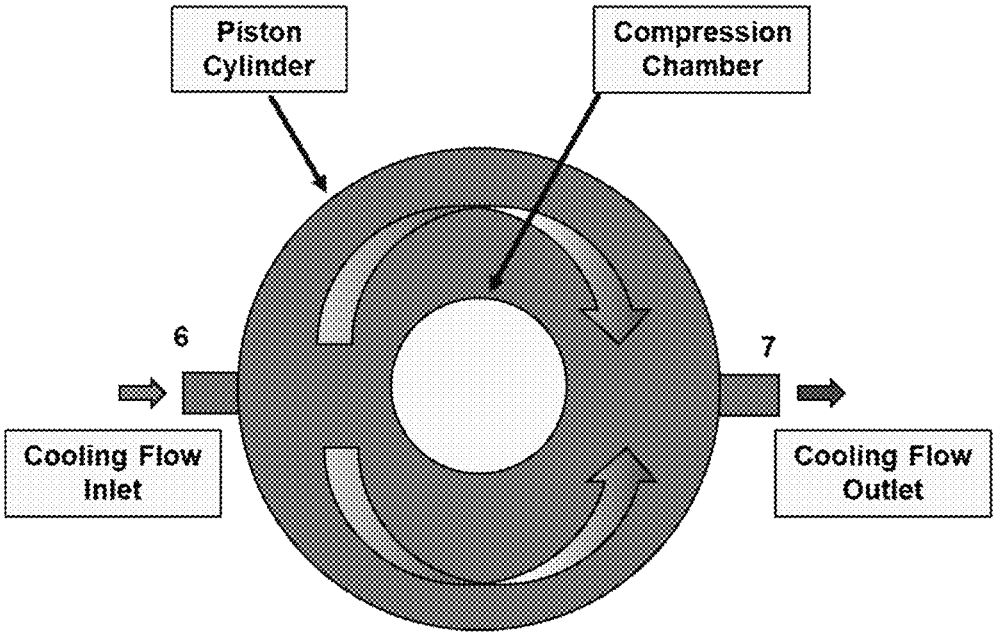
FIG. 3 illustrates the top view of a piston cylinder integrated with cooling paths.

The schematic of the proposed system architecture is shown in FIG. 1 and FIG. 2. FIG. 3 shows a cylinder-piston assembly that includes cooling paths and cylinder injection. Two distinct system features can be noted: (1) a regenerator transfers heat from the liquid refrigerant exiting the condenser to the compressor suction line to ensure high superheat at the compressor inlet; (2) two-phase refrigerant at an intermediate pressure is injected into compressor cooling paths to enable a quasi-isothermal compression process.

The process from point 1 to point 2 as shown in FIG. 2 shows the first stage of compression, wherein a gaseous refrigerant is compressed to an intermediate pressure.

The process from point (2+7) to point 3 as shown in FIG. 2 shows a mixing process, wherein the vapor injection (VI) flow will be mixed with the compressed gas entering from point 2. Then the mixture at point 3 will be compressed to point 4.

The process from point 4 to point 5 as shown in FIG. 1 shows that a superheated pressurized gaseous refrigerant from point 4 is condensed within the condenser to provide a sub-cooled refrigerant at point 5.

At point 5, the sub-cooled refrigerant, once exiting the condenser, is divided into two flow paths through an injection line (point 5 to point 6, and then to point 7) and an evaporation line (point 5 to point 9).

The flow in the injection line is throttled through a throttle valve to an intermediate pressure (point 5 to point 6) and passes through piston cylinder cooling paths absorbing the heat from a compression chamber to form a superheated gaseous refrigerant as an injected vapor (point 6 to point 7) as shown in FIG. 3. The injected flow at state point 7 and the compressed vapor, already inside the compression chamber at state point 2, are mixed and compressed together from state point 3 to state point 4 as shown in FIG. 2.

The flow in the evaporation line, starting from point 5 as a liquid refrigerant, enters the regenerator and exchanges heat with the refrigerant vapor exiting from the evaporator (point 5 to point 8). Then, the liquid refrigerant with higher sub-cooling temperature at state point 8 is throttled through a throttle valve to state point 9 and passes through the evaporator to state point 10.

One very important feature of the present disclosure if the built-in cylinder-piston cooling system as shown as in FIG. 3.

FIG. 3 illustrates a cylinder-piston assembly that includes cooling paths and cylinder injection. The coolant inlet is the two-phase refrigerant that has been throttled from the liquid line to an intermediate pressure between condensing and evaporating pressures (point 6 in FIG. 1 and FIG. 2). The coolant passes through cooling paths around the compressor chamber to absorb the heat from compression process, as shown in FIG. 3, and is evaporated to a superheated vapor at the exit point 7. The coolant flow can be controlled to maintain a desired exit superheat by an optional thermal expansion valve within the cycle.

Figure 4:
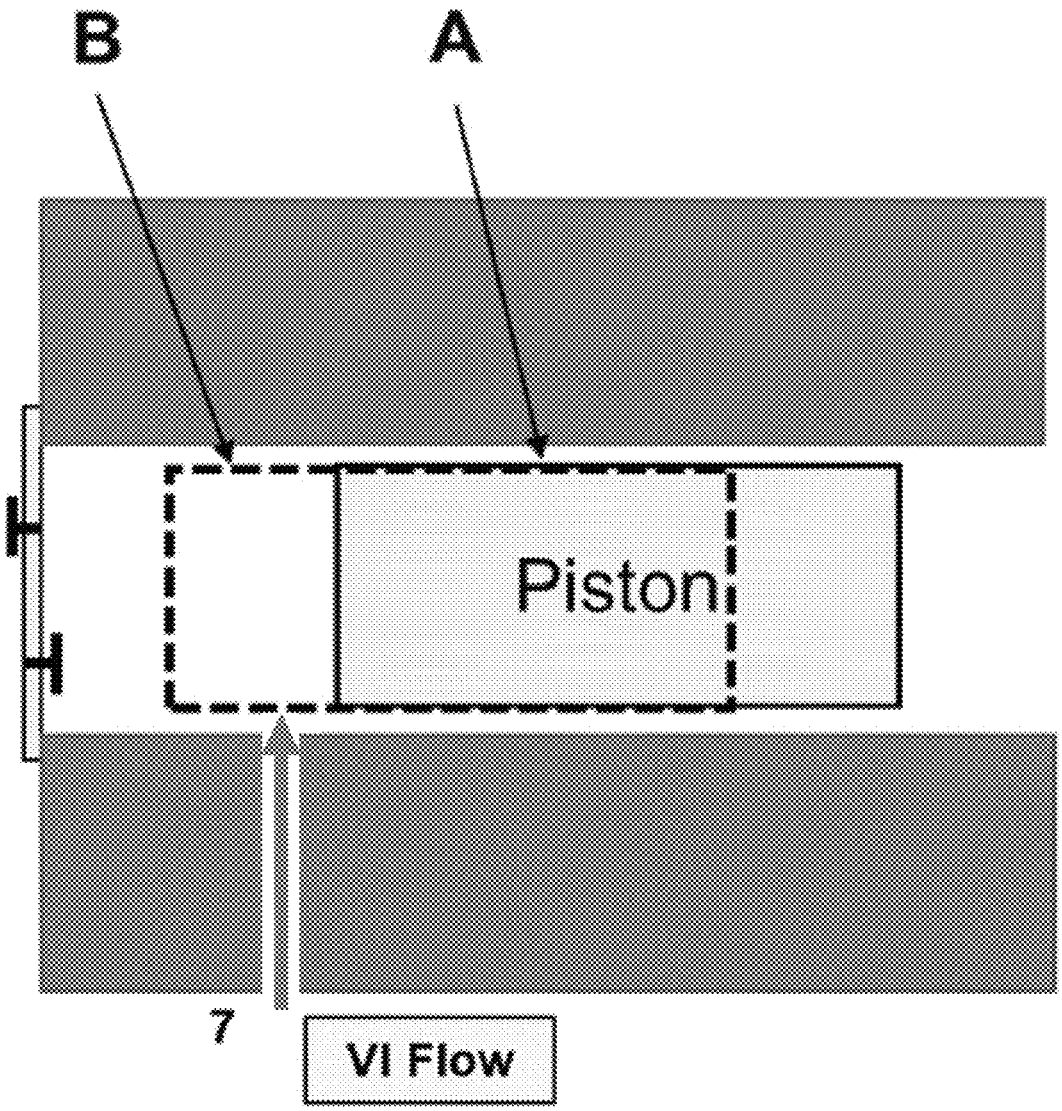
FIG. 4 illustrates the side view of a piston cylinder integrated with injection port.

The superheated gaseous refrigerant at state point 7 is injected into the compression chamber through the cylinder wall, as indicated in FIG. 4. The timing of the vapor injection process is determined by the location of the reciprocating piston. For example, when the piston is at location A in FIG. 4, the chamber pressure is below the intermediate injection pressure and the injection flow will be pushed into the compressor chamber. However, if the piston moves over the injection port, e.g., location B, the injection port will be blocked by the piston wall and there is no further vapor injection until the next cycle. However, some back-flow from compression chamber to the injection line could occur due to the differential pressure, and it may result in a small amount of internal leakage in the compressor. Therefore, the location of the vapor injection port should be chosen wisely.

Cycle Diagram Description

Figure 5:
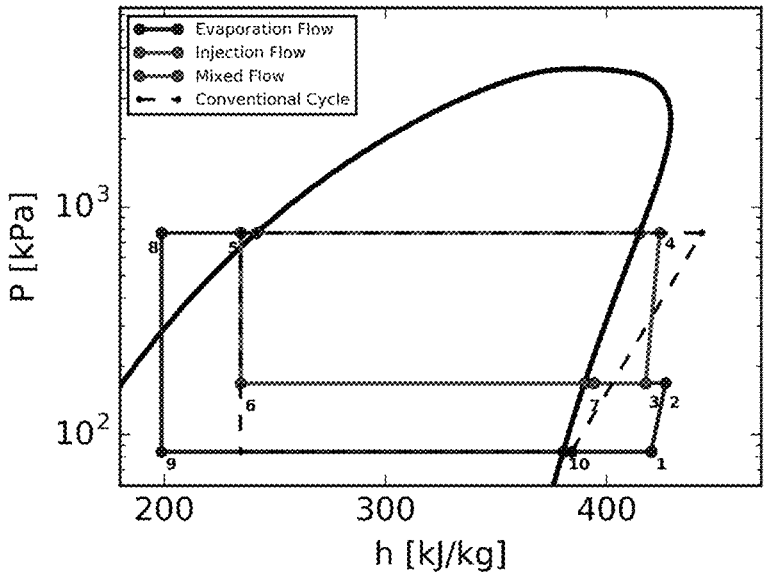
FIG. 5 illustrates vapor injection cycle system with cylinder cooling design: (a) P-h diagram; (b) T-s diagram.
Figure 5:
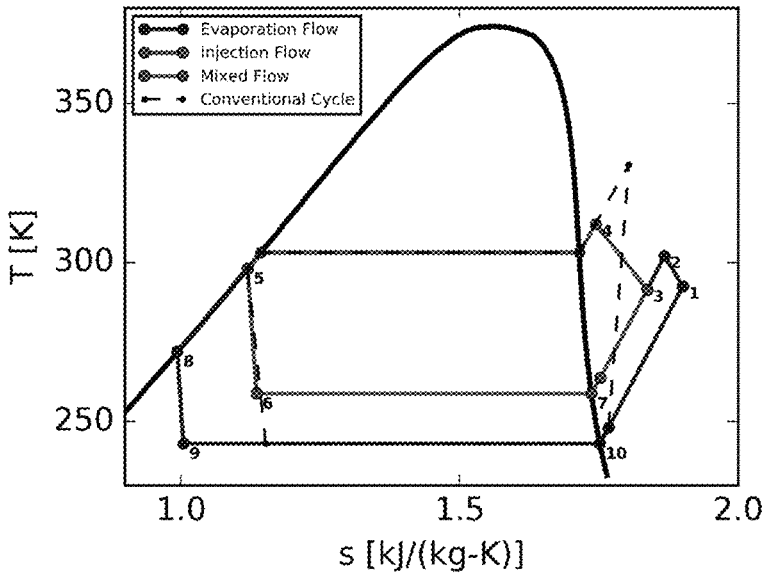

The state points of the aforementioned thermodynamic cycle are shown in P-h and T-s diagrams in FIG. 5(*a*) and FIG. 5(*b*), respectively. In particular, different solid line colors indicate different flow paths, and the dash black lines represent the thermodynamic process of a conventional VCC having the same compressor efficiency. It can be seen that the compressor inlet temperature in the new design (point 1) is significantly higher than that of the conventional cycle, which is due to the use of the regenerator to achieve high superheat. The injection flow at the intermediate pressure is mixed with compressed gas from state point 2 and then compressed together to state point 4 with lower discharge temperature compared to the conventional cycle.

Cycle Modeling and Results

A thermodynamic cycle model has been developed and was used to analyze the proposed system and predict its performance in comparison to the baseline system. As previously outlined, the primary differences between the baseline and proposed system are the vapor injection line, the regenerator, and the cylinder cooling design. A simplified regenerator model with a constant effectiveness is used to model the heat exchange between the compressor suction line and liquid line after the condenser. Moreover, the cylinder cooling effects are considered in a new linear compressor simulation model with constant cylinder wall temperature, which is intimately linked to the cylinder wall temperature and heat transfer surface area. The mixing process between the injected flow and compressed flow is modeled by imposing a mixture energy balance and calculating the resulting mixture temperature.

For the baseline system, the compressor was modeled with a specific isentropic efficiency. The cooled compressor in the proposed system was modeled using polytropic efficiency to account for the significant heat transfer during the compression process. It is also worth pointing out that a cylinder cooling efficiency is used to represent the heat transfer ratio between heat rejection from the compression chamber and heat absorption to the two-phase flow inside the coolant passage. The in-cylinder compression process is modeled as a two-stage compression process with intercooling due to the injection process at the intermediate pressure. The cylinder wall temperature and therefore, the in-cylinder heat transfer during the cooling process is significantly affected by the intermediate pressure (and the corresponding intermediate temperature). The simulation system model described above was employed to investigate the system performance. The inputs to the model are listed in Table 1.

TABLE 1

Inputs used for the system simulation model

| Description | Parameter | Proposed Sys. | Baseline Sys. | Unit |
|---|---|---|---|---|
| Working Fluid | — | R134a | R134a | — |
| Evaporating Temperature | $T_{evap}$ | −30 | −30 | ° C. |
| Condensing Temperature | $T_{cond}$ | 30 | 30 | ° C. |
| Superheat Temperature | $\Delta T_{sup}$ | 5 | 5 | ° C. |
| Subcooling Temperature | $\Delta T_{sub}$ | 5 | 5 | ° C. |
| Compressor Efficiency | $\eta_{com}$ | 0.8 | 0.8 | — |
| Cylinder Cooling Efficiency | $\eta_{cyl}$ | 0.85 | — | — |
| Regenerator Efficiency | $\varepsilon_{re}$ | 0.8 | — | — |
| Intermediate Pressure Ratio | $PR_{int}$ | 2.5 | — | — |

Figure 6:
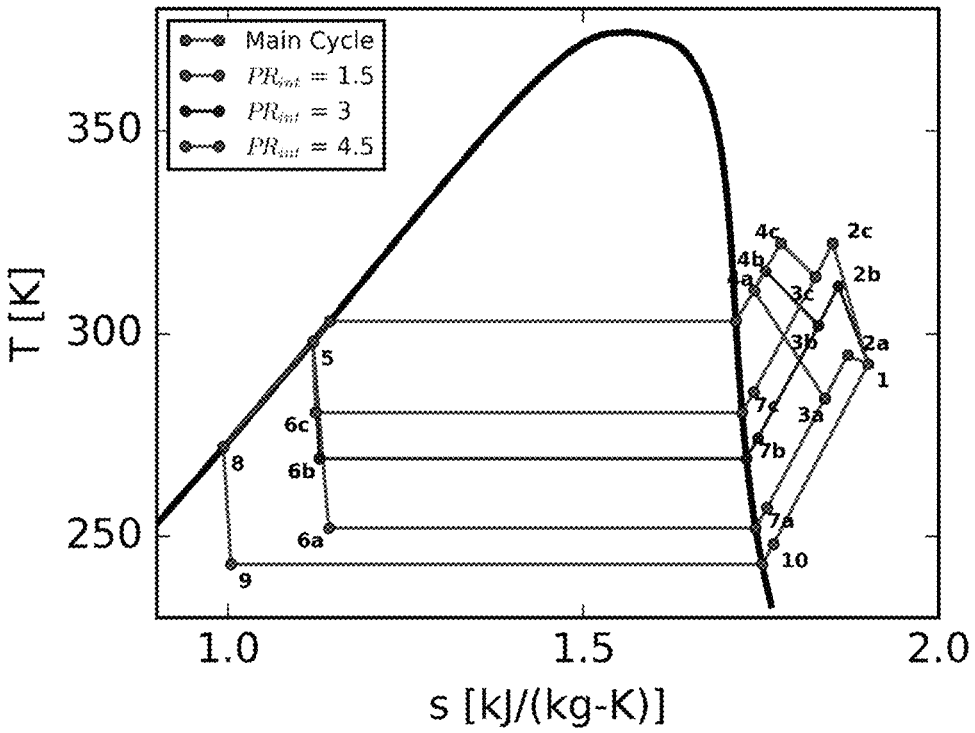
FIG. 6 illustrates T-s diagram of vapor injection cylinder cooling system with different intermediate pressures.
Figure 7:
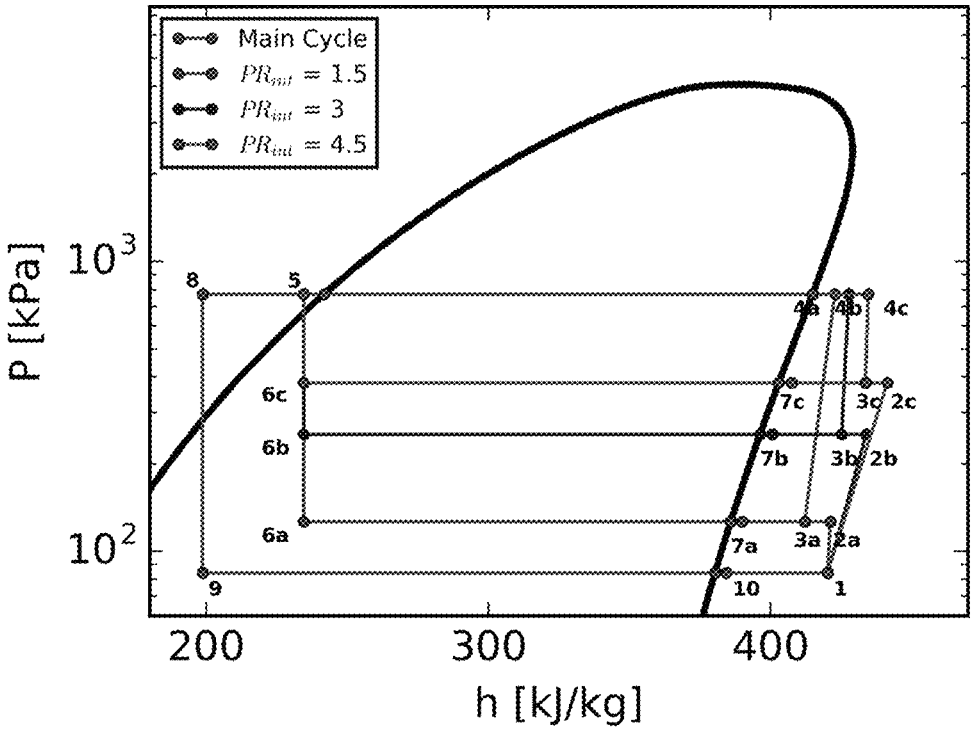
FIG. 7 illustrates P-h diagram of vapor injection cylinder cooling system with different intermediate pressures.

FIG. 6 and FIG. 7 depict different injection processes at different intermediate pressures ratios. It can be seen that a smaller intermediate pressure ratio results in lower cylinder wall temperatures, which results in more heat removal from the compression chamber as a larger temperature difference exists for the in-cylinder heat transfer. In addition, larger cooling capacities can be obtained at lower intermediate pressures for the cylinder cooling, which is determined by the enthalpy change between state points 6 and 7. Therefore, with the decrease of the intermediate pressure ratio from 4.5 to 1.5, the compressor discharge temperatures decrease accordingly (state points 4*c*, 4*b*, 4*a*), which makes the overall two-stage compression process (1 to 4) closer to a quasi-isothermal process (also see FIG. 8). For that reason, the polytropic index n approaches unity (isothermal process), which leads to a decrease in reversible polytropic and actual specific work. However, a lower intermediate pressure also leads higher bypass flow to the compressor and reduced refrigerant flow through the evaporator. Thus, there is an optimum intermediate pressure.

Figure 8:
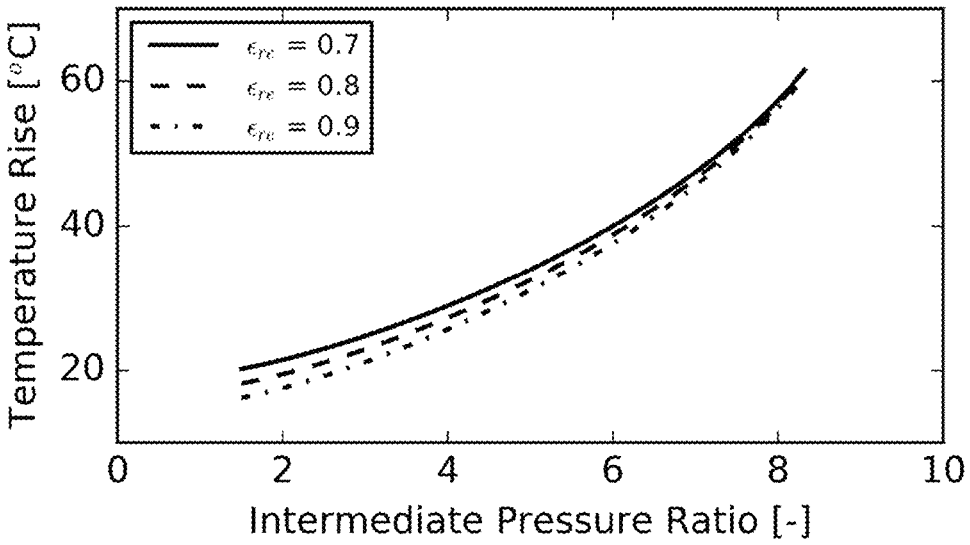
FIG. 8 illustrates compressor temperature rise versus intermediate pressure ratio for different regenerator efficiencies.

FIG. 8 depicts the variation of the compressor temperature rise as a function of different intermediate pressure ratios for three different values of the regenerator efficiency. As previously discussed, decreasing intermediate pressure leads to a reduced temperature rise due to a lower coolant temperature. Moreover, it is also observed that a higher regenerator efficiency leads to a lower temperature rise since a higher inlet temperature allows for larger temperature difference for in-cylinder heat transfer.

Figure 9:
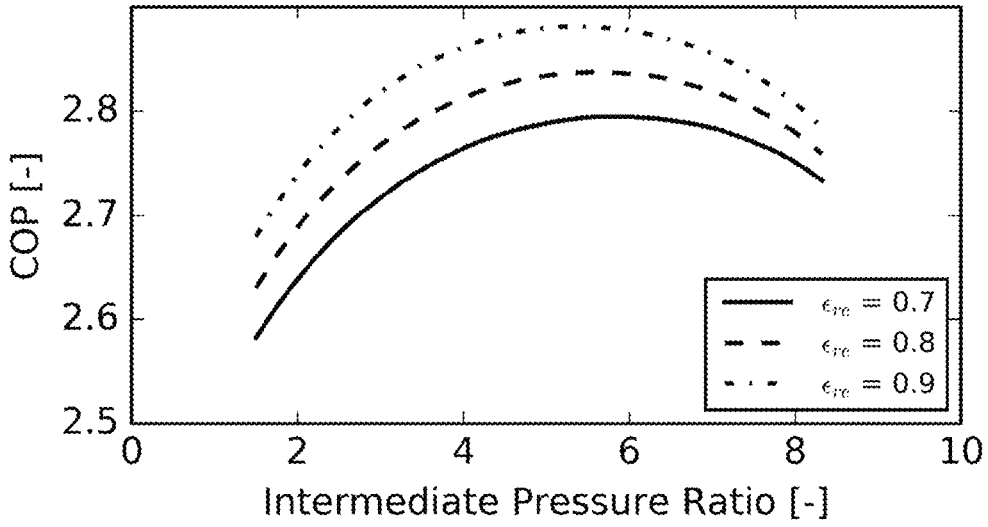
FIG. 9 illustrates system COP versus intermediate pressure for different regenerator efficiencies.

However, the refrigerant flow to the evaporator decreases with increasing flow to the compressor as the intermediate pressure is reduced. This leads to a reduction in system cooling capacity which counters the positive effect of reduced compressor specific work. Therefore, there is an optimal intermediate pressure for the best system performance, which is very similar to a standard multiple-stage compression process. FIG. 9 shows system coefficient of performance (COP) as a function of intermediate pressure ratio for different regenerator efficiencies. The optimum intermediate pressure ratio is between about 5 and 6 for this case. COP increases with regenerator efficiency, but it has an insignificant effect on the optimum intermediate pressure that maximizes COP.

Figure 10:
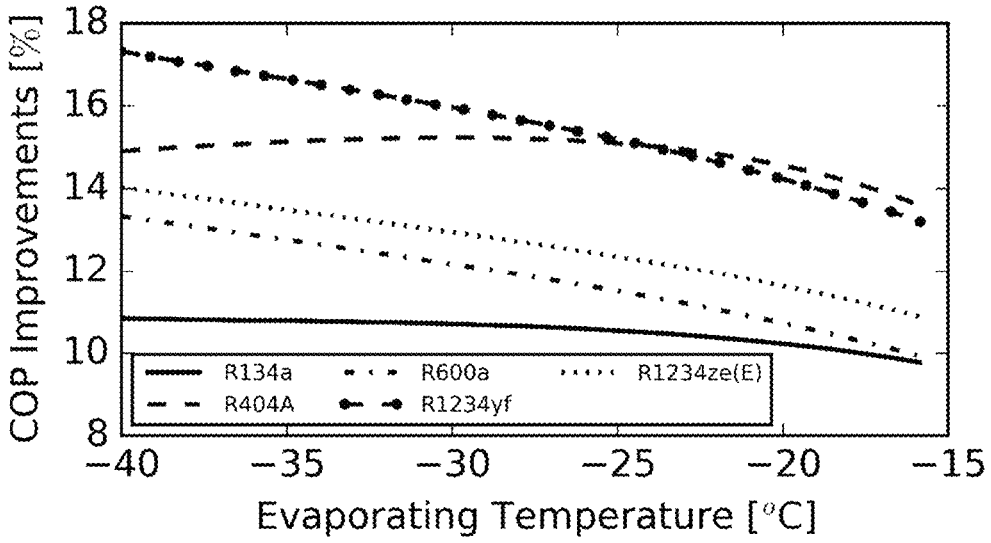
FIG. 10 illustrates System COP improvements from a conventional VCRC versus evaporating temperature for different working fluids.

To further investigate the benefits of the designed cylinder cooling and vapor injection system with respect to the conventional vapor compression system, the simulation model is exercised to account for different operating conditions. To ensure a consistent comparison, all selected operating conditions are imposed to both cycle architectures, and the COP improvements from the conventional cycle is used as the parameter to identify the differences. Additionally, some of the common working fluids are selected to quantify the effect of working fluid selection on the system performance. It is shown in FIG. 10 that the designed system has higher COPs than that of the conventional vapor compression system for all four selected refrigerants. In particular, an improvement can be found with the use of refrigerant R1234yf operating at lower evaporating temperatures because the proposed system can reduce the desuperheating loss, which is a predominant loss in the conventional vapor compression system when the evaporating temperature drops for a constant condenser temperature.

This paper presents a new concept of an oil-free linear compressor with piston/cylinder cooling, vapor injection, and regeneration. The performance of this technology was assessed for a number of different refrigerants and operating conditions using a system simulation model. Several conclusions can be drawn from the results as follows.

- The proposed system design can significantly reduce the compressor temperature rise compared to a conventional system, but the temperature rise depends on the intermediate pressure.
- There is an optimum intermediate pressure for cylinder cooling and vapor injection in terms of achieving the best overall system COP.
- Although overall system performance is strongly dependent on the regenerator effectiveness, the optimum intermediate pressure is relatively insensitive to the regenerator effectiveness.
- The proposed system showed between 10% and 18% improvements in performance compared to the conventional system. The greatest improvements occurred with R1234yf as the working fluid, especially at larger temperature lifts.

Those skilled in the art will recognize that numerous modifications can be made to the specific implementations described above. The implementations should not be limited to the particular limitations described. Other implementations may be possible.

We claim:

1. A vapor compression refrigeration system, wherein the system comprises a main circuit comprising:

a compressor comprising a compression chamber and a cooling chamber, wherein the compression chamber further comprises a first inlet and a first outlet, and the cooling chamber further comprises a second inlet and a second outlet;

a condenser configured to receive a superheated pressurized gaseous refrigerant from the first outlet of the compression chamber, and to condense the superheated pressurized gaseous refrigerant to a sub-cooled refrigerant liquid;

a regenerator configured for heat exchanging;

an evaporator configured to convert a liquid/pressurized gaseous two-phase refrigerant to a gaseous refrigerant;

an injection line between the condenser and the second inlet of the cooling chamber of the compressor, wherein a first throttle valve is placed on the injection line, and the first throttle valve is configured to convert a liquid refrigerant to a liquid/pressurized gaseous two-phase refrigerant; and an evaporation line connecting the condenser and the evaporator, wherein a second throttle valve is placed on the evaporation line, and the second throttle valve is configured to convert a liquid refrigerant to a liquid/pressurized gaseous two-phase refrigerant, wherein the second inlet and the second outlet of the cooling chamber are configured to allow the second inlet to receive the liquid/pressurized gaseous two-phase refrigerant from the first throttle valve to enter the cooling chamber to absorb heat generated from the compression chamber until the superheated pressurized gaseous refrigerant is achieved at the second outlet and allow the superheated pressurized gaseous refrigerant to be released from the second outlet and be injected to the compression chamber.

2. The vapor compression refrigeration system of claim 1, wherein the compressor is a reciprocating piston compressor, a linear compressor, a rolling piston compressor, a single/twin screw compressor, a rotary compressor, or a scroll compressor.

3. The vapor compression refrigeration system of claim 2, wherein the compressor is an oil-free linear compressor.

4. A refrigerating unit comprising the vapor compression refrigeration system of claim 1.

5. A vapor compression refrigeration system, wherein the system comprises a main circuit comprising:

a compressor comprising a compression chamber and a cooling chamber, wherein the compression chamber further comprises a first inlet and a first outlet, and the cooling chamber further comprises a second inlet and a second outlet;

a condenser configured to receive a superheated pressurized gaseous refrigerant from the first outlet of the compression chamber, and to condense the superheated pressurized gaseous refrigerant to a sub-cooled refrigerant liquid;

a regenerator configured for heat exchanging;

an evaporator configured to convert a liquid/pressurized gaseous two-phase refrigerant to a gaseous refrigerant;

an injection line between the condenser and the second inlet of the cooling chamber of the compressor, wherein a first throttle valve is placed on the injection line, and the first throttle valve is configured to convert a liquid refrigerant to a liquid/pressurized gaseous two-phase refrigerant and an evaporation line connecting the condenser and the evaporator, wherein a second throttle valve is placed on the evaporation line, and the second throttle valve is configured to convert a liquid refrigerant to a liquid/pressurized gaseous two-phase refrigerant, wherein the liquid/pressurized gaseous two-phase refrigerant from the second throttle valve is passed through the evaporator to become a first superheated pressurized gaseous refrigerant, and then passed through the regenerator to become a second more superheated pressurized gaseous refrigerant than the first superheated pressurized gaseous refrigerant, wherein the second more superheated pressurized gaseous refrigerant is delivered to the compression chamber to be compressed to a first compressed gaseous refrigerant, wherein the first compressed gaseous refrigerant is mixed with the superheated pressurized gaseous refrigerant released from the second outlet of the cooling chamber to form a gaseous mixture, wherein the gaseous mixture is further compressed to a second compressed gaseous refrigerant.

* * * * *